US006219985B1

(12) United States Patent
Hsu

(10) Patent No.: US 6,219,985 B1
(45) Date of Patent: Apr. 24, 2001

(54) LOUVER AND FRAME BODY ASSEMBLY STRUCTURE

(75) Inventor: Peyson S. Hsu, Changhua Hsien (TW)

(73) Assignee: Ching Feng Blinds Ind. Co. Ltd., Changhua Hsien (TW)

( * ) Notice: Subject to any disclaimer, the term of this patent is extended or adjusted under 35 U.S.C. 154(b) by 0 days.

(21) Appl. No.: 09/420,484

(22) Filed: Oct. 19, 1999

(51) Int. Cl.[7] ..... E06B 7/08
(52) U.S. Cl. ..... 52/473; 160/235
(58) Field of Search ..... 52/473, 311.3, 52/311.1; 160/235; 49/74.1, 403, 87.1

(56) References Cited

U.S. PATENT DOCUMENTS

| | | | | |
|---|---|---|---|---|
| 3,031,013 | * | 4/1962 | Russell | 49/403 |
| 3,968,738 | * | 7/1976 | Matzke | 52/473 X |
| 4,972,894 | * | 11/1990 | Machill | 160/235 |
| 5,191,735 | * | 3/1993 | Ross | 49/403 X |
| 5,339,591 | * | 8/1994 | Underdahl | 49/74.1 X |
| 5,392,577 | * | 2/1995 | D'Onofrio, Jr. et al. | 52/473 |
| 5,490,353 | * | 2/1996 | McLaughlin | 49/74.1 X |
| 5,496,630 | * | 3/1996 | Hawrylko et al. | 49/74.1 X |
| 5,572,831 | * | 11/1996 | Rafiqui | 49/403 |
| 5,775,399 | * | 7/1998 | Shields, Jr. | 49/74.1 X |
| 5,778,598 | * | 7/1998 | Ohanesian | 49/74.1 |
| 5,887,386 | * | 3/1999 | Alexanain et al. | 49/74.1 X |
| 5,941,021 | * | 8/1999 | Valls, Jr. et al. | 49/403 X |
| 6,041,547 | * | 3/2000 | Marocco | 49/87.1 |

FOREIGN PATENT DOCUMENTS

| | | | | |
|---|---|---|---|---|
| 1534903 | * | 8/1968 | (FR) | 52/473 |
| 1558797 | * | 1/1969 | (FR) | 49/74.1 |

* cited by examiner

*Primary Examiner*—Jose V. Chen
(74) *Attorney, Agent, or Firm*—Dougherty & Troxell

(57) ABSTRACT

A louver and frame body assembly structure including an upper beam, a lower beam, two lateral columns, two side columns, several slats, a linking bar and several pivot nails. The outer peripheries of the main bodies of the upper beam, lower beam and lateral columns are all coated with an opaque layer on which decorative articles are placed. The outermost faces is further wrapped by a transparent plastic layer by cold rolling or injection so as to enclose and fix the decorative articles therein. The upper and lower end sections of the left and right sides are formed with locking holes. The inner side between the upper and lower end sections are formed with several pivot holes. Each slat includes an elongated opaque sheet. Decorative articles are placed on two faces of the sheet. A transparent layer is integrally overlaid on the opaque sheet and the outer sides of the decorative articles to form the slat witha flat arch cross-section. At the same time, two sides of the slat are disposed with resilient pivot heads. One corner of the slat is formed with an L-shaped notch. The linking bar has several pivot lugs parallelly inward extending from lateral side at equal intervals. Each pivot lug is formed with a through hole. In addition, the linking bar has driving sections perpendicularly laterally extending inward between the pivot lugs at equal intervals.

1 Claim, 7 Drawing Sheets

LOUVER AND FRAME BODY ASSEMBLY STRUCTURE

BACKGROUND OF THE INVENTION

The present invention relates to a louver and frame body assembly structure in which various kinds of natural solid pictures and patterns are formed on the beams, columns and slats to beautify the appearance of the louver and frame body. The pictures are coated with a transparent layer which endures the pictures. By means of pivot nails, the linking bar is pivotally connected with the lateral sides of the slats so that it is easy and convenient to assemble the components of the louver.

FIG. 1 shows a conventional louver and frame body structure including an upper beam 10, a lower beam 11, two lateral columns 12, several slats 20, several driven latch hooks 21, several pivot pins 22, a linking bar 30 and several driving latch hooks 31. The upper beam 10 is an elongated slat-like member having a substantially L-shaped cross-section. The recessed section of the upper beam 10 is disposed with a semicircular receiving cavity 101. The lower beam 11 is an elongated slat-like member having a substantially L-shaped cross-section. The two lateral columns 12 are also slat-shaped and are opposite to each other. The opposite inner sides thereof are formed with several pivot sockets 121 at equal intervals. The middle of each of the left and right sides of the slat 20 is formed with an insertion hole 201. The driven latch hook 21 is U-shaped. The pivot pin 22 is a two-step cylindrical member. The linking bar 30 is an elongated bar. The driving latch hook 31 is U-shaped.

When assembled, as shown in FIG. 2, the small diameter steps of several pivot pins 22 are respectively fixedly fitted into the insertion holes 201 of left and right sides of the slats 20. Then several driving latch hooks 31 are nailed on the linking bar 30 at equal intervals. Then several driven latch hooks 21 are latched with the driving latch hooks 31 on the linking bar 30 and nailed on the upper sides of the slats 20. Then the upper beam 10, lower beam 11 and two lateral columns 12 are assembled to form a rectangular frame body. At the same time, the pivot pins 22 fixed in the insertion holes 201 of the slats 20 are pivotally fitted into the pivot sockets 121 of the lateral columns 12. Accordingly, by means of moving the linking bar 30, the slats 20 are driven to pivotally rotate between the lateral columns 12 so as to adjust the light shading effect.

The conventional louver and frame body has some shortcomings as follows:

1. The upper and lower beams 10, 11, lateral columns 12, slats 20 and linking bar 30 are all made of wooden material or other materials with identical properties which are sprayed with paint with monotonous color. After a long period of being sunned, the paint tends to detach and the appearance will be deteriorated. Under such circumstance, re-painting is necessary.

2. The driving latch hooks 31 are nailed on the linking bar 30 and the driven latch books 21 are latched with the driving latch hooks 31 and then nailed on the upper sides of the slats 20. In addition, the slats 20 must be pivotally connected with the lateral columns 12 via the independent pivot pins 22. Such assembling procedure is quite troublesome.

3. The linking bar 30 is positioned at the center of the louver. This affects the entire appearance of the louver.

SUMMARY OF THE INVENTION

It is therefore a primary object of the present invention to provide a louver and frame body assembly structure in which the outer peripheries of the frame body and slats are disposed with opaque layers and decorative articles wrapped by transparent layers. The opaque layers can be made of paper material, recovered paper material, wooden sheet, plastic material, unwoven fabric, woven fabric, etc. The decorative articles can be made of dried flowers, decorative papers, etc. Therefore, various kinds of solid pictures and patterns can be achieved to beautify and endure the appearance.

It is a further object of the present invention to provide the above louver and frame body assembly structure in which by means of the pivot nails, the slats are directly pivotally connected with the linking bar. The resilient pivot heads are integrally formed with the slat so that it is easy and convenient to assemble the components.

It is still a further object of the present invention to provide the above louver and frame body assembly structure in which the linking bar is disposed on lateral side of the slats near the lateral column so that the entire appearance and picture of the louver will not be affected.

The present invention can be best understood through the following description and accompanying drawings wherein:

DETAILED DESCRIPTION OF THE PREFERRED EMBODIMENT

Figure 1:
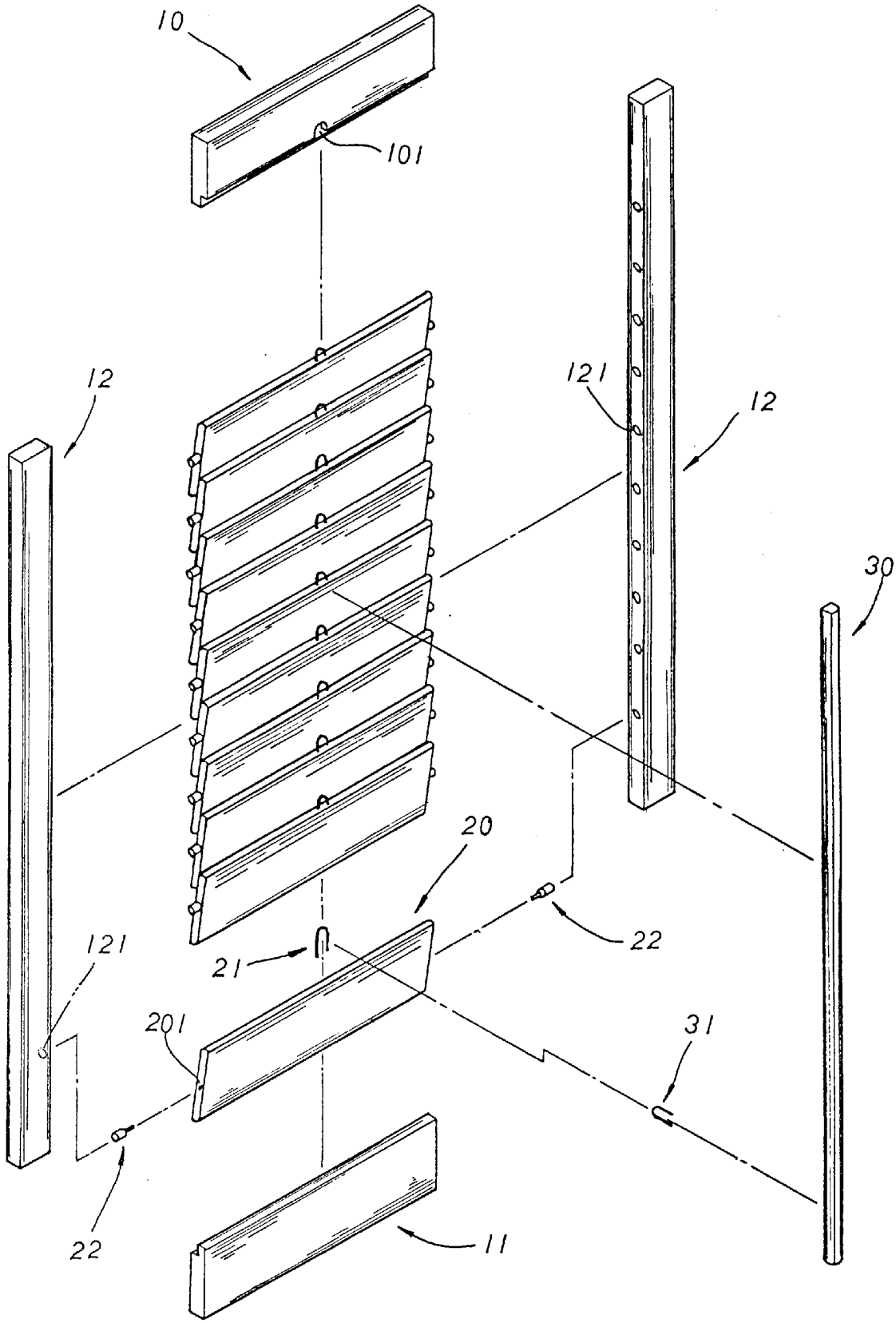
FIG.1 PRIOR ART
FIG. 1 is a perspective exploded view of a conventional louver and frame body thereof.
Figure 2:
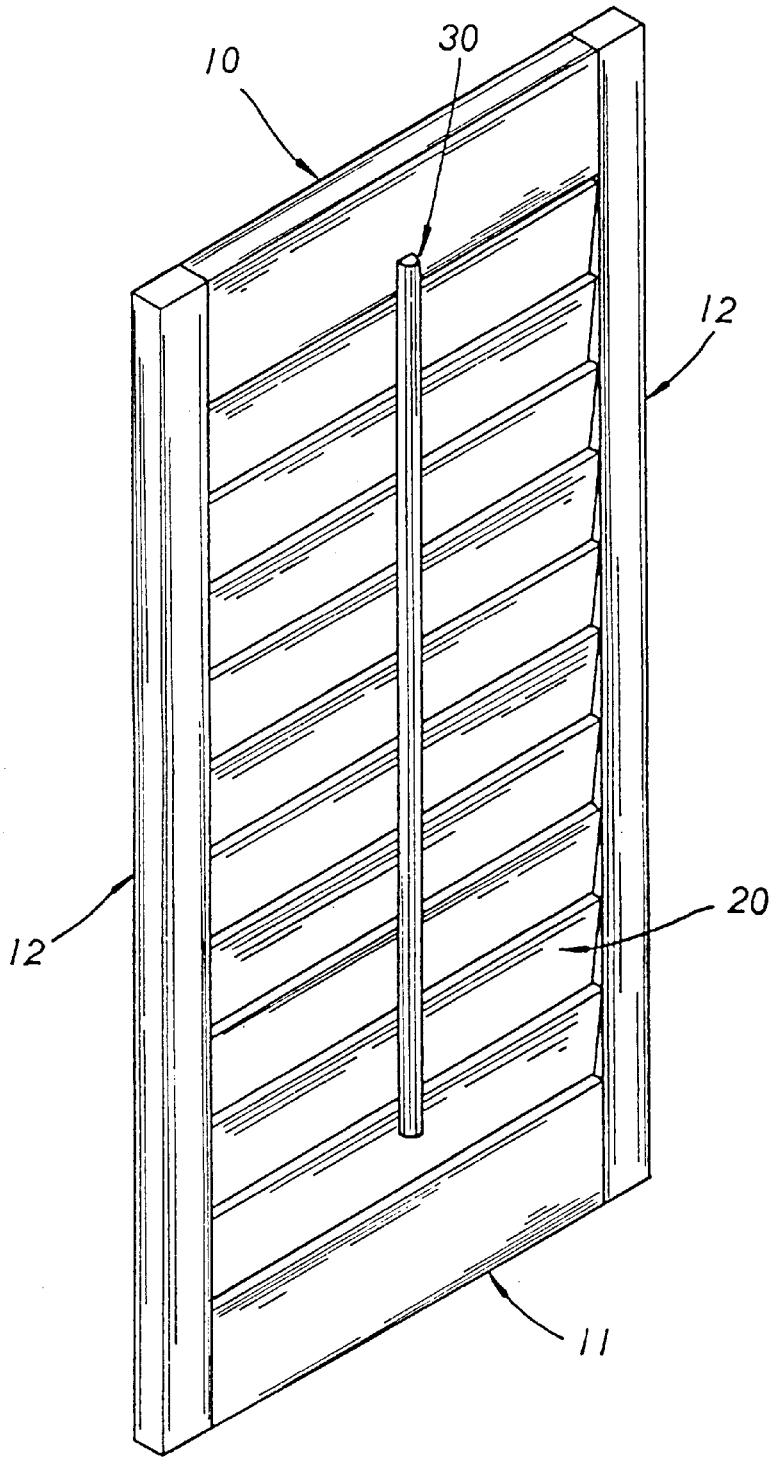
FIG.2 PRIOR ART
FIG. 2 is a perspective assembled view of the conventional louver and frame body thereof.
Figure 3:
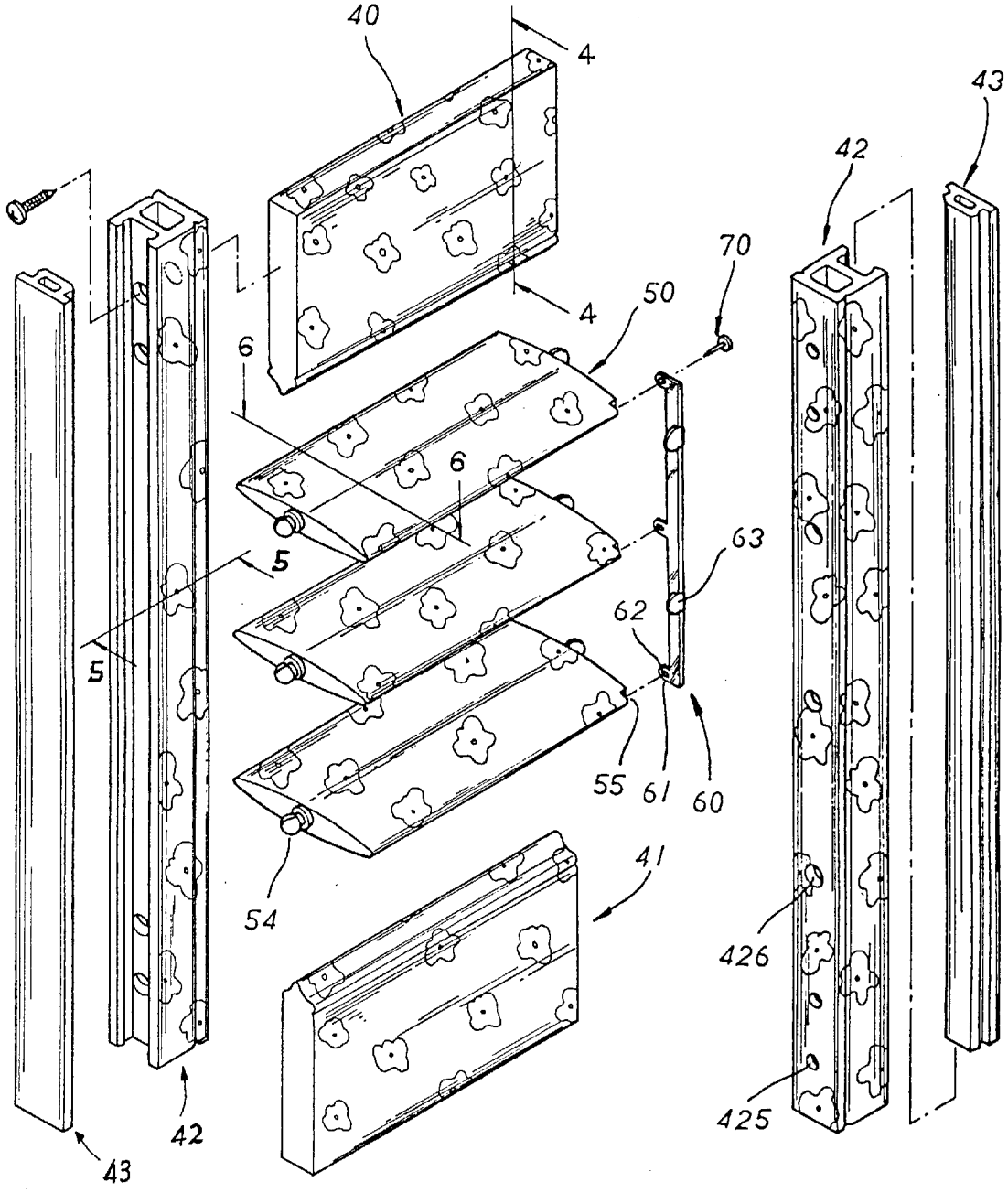
FIG. 3 is a perspective exploded view of the louver and frame body of the present invention.
Figure 4:
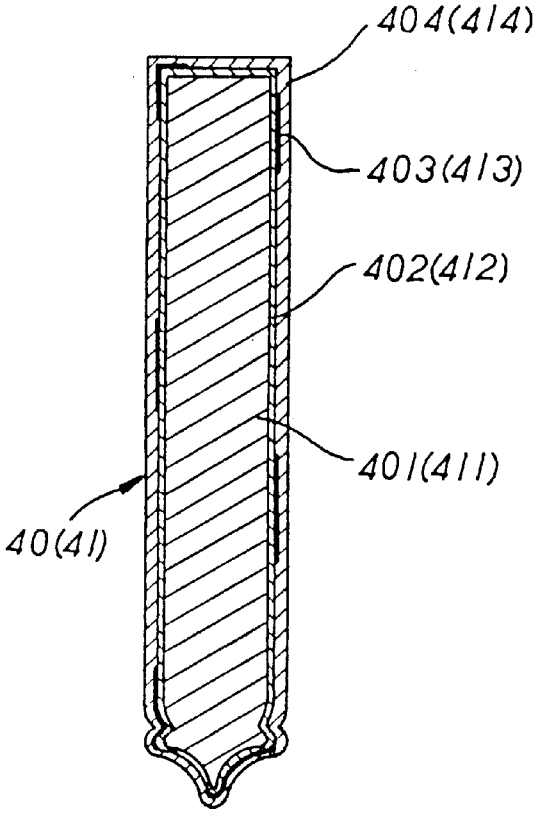
FIG. 4 is a sectional view taken along line 4—4 of FIG. 3.
Figure 5:
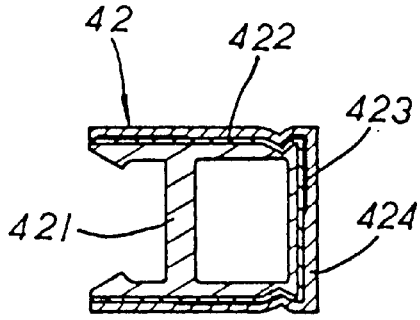
FIG. 5 is a sectional view taken along line 5—5 of FIG. 3.
Figure 6:
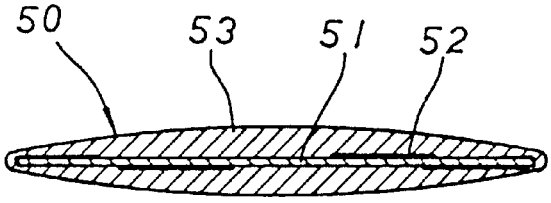
FIG. 6 is a sectional view taken along line 6—6 of FIG. 3.

Please refer to FIG. 3. The louver and frame body assembly structure of the present invention includes an upper beam 40, a lower beam 41, two lateral columns 42, two side columns 43, several slats 50, a linking bar 60 and several pivot nails 70. The upper beam 40 includes a slat-like main body 401 the bottom of which is tapered and arched. The main body 401 is coated with an opaque layer 402 on which decorative article 403 is overlaid. The outermost face is further wrapped by a transparent plastic layer 404 by cold rolling or injection to enclose and fix the decorative article 403 therein (referring to FIG. 4 taken along line A—A of FIG. 3). The lower beam 41 includes a slat-like main body 411 the top of which is tapered and arched. The main body 411' is coated with an opaque layer 412 on which decorative article 413 is overlaid. The outermost face is further wrapped by a transparent plastic layer 414 by cold rolling or injection to enclose and fix the decorative article 413 therein (referring to FIG. 4 taken along line A—A of FIG. 3). The two lateral columns 42 include rectangular bar-like main bodies 421 opposite to each other. The inner, front and rear sides of the lateral columns 42 are coated with an opaque layer 422 on which decorative article 423 is overlaid. The outermost face is further wrapped by a transparent plastic layer 424 by cold rolling or injection to enclose and fix the decorative article 423 on the three sides (referring to FIG. 5 taken along line B—B of FIG. 3). The upper and lower end sections of the left and right sides are formed with locking holes 425. The inner side between the upper and lower end sections is formed with several pivot holes 426 at equal intervals. The side column 43 is slat-like and fitted with outer side of the lateral column 42. The slat 50 includes an elongated opaque sheet 51. Decorative articles 52 are placed on two faces of the sheet 51. Then a transparent layer 53 is integrally overlaid on the opaque sheet 51 and the outer sides of the decorative articles 52 to form the slat with a flat arch cross-section (referring to FIG. 6 taken along line C—C of FIG. 3). At the same time, two sides of the slat are disposed with resilient pivot heads 54. In addition, one corner of the slat 50 is formed with an L-shaped notch 55. The linking bar 60 has several pivot lugs 61 parallelly inward extending from lateral side at equal intervals. Each pivot lug 61 is formed with a through hole 62. In addition, the linking bar 60 has driving sections 63 perpendicularly laterally extending inward between the pivot lugs 61 at equal intervals.

The above opaque layers 402, 412, 422, 51 can be made of paper material, recovered paper material, wooden sheet, plastic material, unwoven fabric, woven fabric, etc. The decorative articles 403, 413, 423, 52 can be made of dried flowers, decorative papers, etc.

Figure 7:
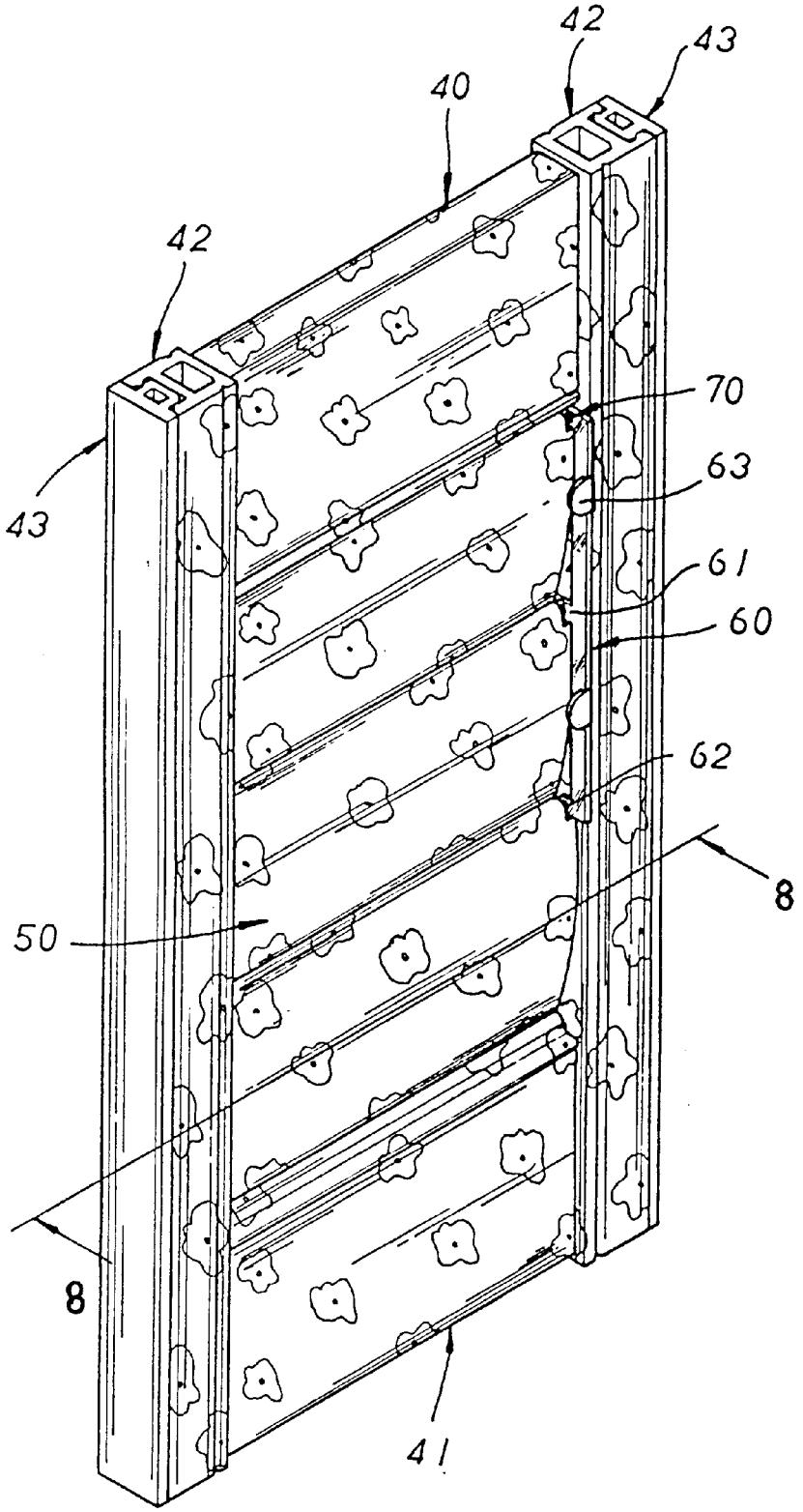
FIG. 7 is a perspective assembled view of the louver and frame body of the present invention.
Figure 8:
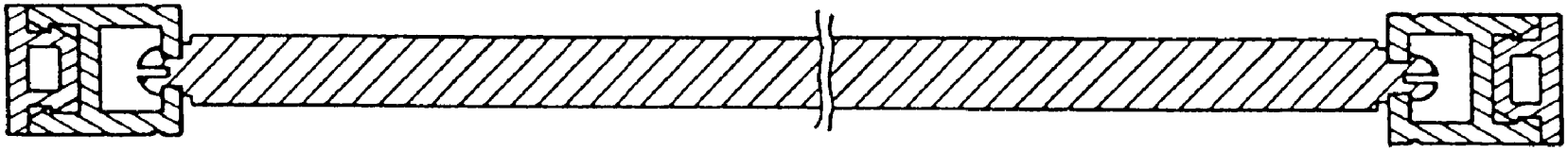
FIG. 8 is a sectional view taken along line 8—8 of FIG. 7.

Please refer to FIG. 7. When assembled, the pivot nail 70 is first passed through the through holes 62 of the linking bar 60 and fixedly nailed on the notch 55 of the slat 50. At this time, the slat 50 can be rotated on the pivot lug 61 about the pivot nail 70. Then the upper and lower beams 40, 41 are respectively placed between the upper and lower end sections of the two lateral columns 42. Screws are passed through the locking holes 425 of the lateral columns 42 to fixedly lock the upper and lower beams 40, 41. Then the resilient pivot heads 54 on left and right sides of the slat 50 are respectively contracted and intruded into the pivot holes 426 of the lateral columns 42 and pivotally connected therewith. Finally, the side columns 43 are downward fitted and engaged with the outer sides of the lateral columns 42 (referring to FIG. 8 taken along line D—D of FIG. 7) to complete the assembly.

Figure 9:
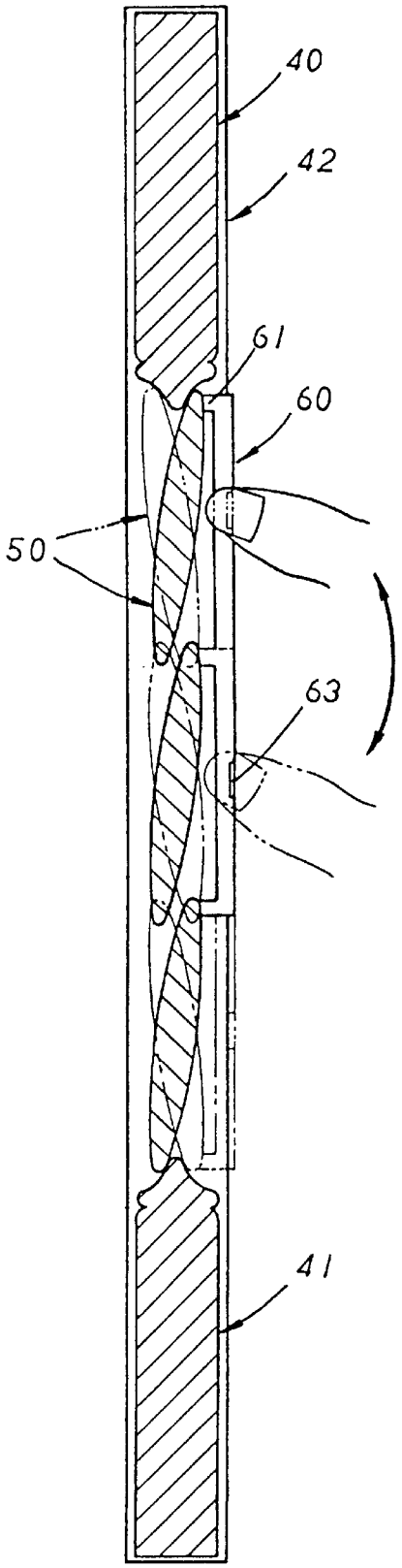
FIG. 9 shows the operation of the present invention.

In use, referring to FIG. 9, the driving section 63 of the linking bar 60 is shifted through a vertical arch path, whereby the linking bar 60 can drive the respective slats 50 to pivotally rotate between the two lateral columns 42 so as to adjust the light shading effect.

According to the above arrangement, the present invention has the following advantages:

1. By means of the pivot nails 70, the slats 50 are directly pivotally connected with the linking bar. The resilient pivot heads 54 are integrally formed with the slat 50 so that it is easy and convenient to assemble the components.

2. The outer peripheries of the upper beam 40, lower beam 41, lateral columns 42 and slats 50 are disposed with opaque layers 402, 412, 422, 51 and decorative articles 403, 413, 423, 52 wrapped by transparent layers 404, 414, 424, 53. The opaque layers 402, 412, 422, 51 can be made of paper material, recovered paper material, wooden sheet, plastic material, unwoven fabric, woven fabric, etc. The decorative articles 403, 413, 423, 52 can be made of dried flowers, decorative papers, etc. Therefore, various kinds of solid pictures and patterns can be achieved to beautify and endure the appearance.

3. The linking bar 60 is disposed on lateral side of the slats 50 near the lateral column 42 so that the entire appearance and picture of the louver will not be affected.

The above embodiment is only used to illustrate the present invention, not intended to limit the scope thereof. Many modifications of the above embodiment can be made without departing from the spirit of the present invention.

What is claimed is:

1. A louver and frame body assembly structure comprising an upper beam, a lower beam, two lateral columns, two side columns, several slats, a linking bar and several pivot nails, wherein:

the upper beam includes a slat-like main body the bottom of which is tapered and arched, the main body being coated with an opaque layer on which decorative article is overlaid, an outer face of the opaque layer and decorative article being wrapped by a transparent layer;

the lower beam includes a slat-like main body the top of which is tapered and arched, the main body being coated with an opaque layer on which decorative article is overlaid, an outer face of the opaque layer and decorative article being wrapped by a transparent layer;

each of the lateral columns includes rectangular bar-like main body, an inner, front and rear sides of the lateral columns being coated with an opaque layer on which decorative article is overlaid, an outer of the opaque layer and decorative article being wrapped by a transparent layer, the upper and lower end sections of the left and right sides being formed with locking holes, the inner side between the upper and lower end sections being formed with several pivot holes;

each slat includes an elongated opaque sheet, decorative articles being placed on two faces of the sheet, a transparent layer being integrally overlaid on the opaque sheet and the outer sides of the decorative articles to form the slat with a flat arch cross-section, at the same time, two sides of the slat being disposed with resilient pivot heads, one corner of the slat being formed with an L-shaped notch;

the linking bar has several pivot lugs parallelly inward extending from lateral side at equal intervals, each pivot lug being formed with a through hole, the linking bar having driving sections perpendicularly laterally extending inward between the pivot lugs at equal intervals; and the pivot nail is first passed through the through holes of the linking bar and fixedly nailed on the notch of the slat, the upper and lower beams being respectively placed between the upper and lower end sections of the two lateral columns, the resilient pivot heads on left and right sides of the slat being respectively contracted and intruded into the pivot holes of the lateral columns and pivotally connected therewith, the side columns being fitted and engaged with the outer sides of the lateral columns.

* * * * *